United States Patent [19]

Johnson

[11] Patent Number: 4,967,494

[45] Date of Patent: Nov. 6, 1990

[54] WATERPROOF INSULATED SOCK WITH FOOT CONFORMING CAPABILITY

[75] Inventor: James J. Johnson, Sidney, Nebr.

[73] Assignee: Cabela's, Inc., Sidney, Nebr.

[21] Appl. No.: 441,337

[22] Filed: Nov. 21, 1989

Related U.S. Application Data

[63] Continuation of Ser. No. 144,140, Jan. 15, 1988, abandoned.

[51] Int. Cl.[5] ..... A43B 1/02; A43B 17/00; A43B 17/08

[52] U.S. Cl. ..... 36/9 R; 2/239

[58] Field of Search ..... 36/9 R, 10; 2/239, 240, 2/241

[56] References Cited

U.S. PATENT DOCUMENTS

| | | | |
|---|---|---|---|
| 2,334,659 | 11/1943 | Van Arsdale et al. | 36/9 R |
| 2,770,055 | 11/1956 | Hayden | 36/9 R |
| 3,016,631 | 1/1962 | Servin | 36/9 R |
| 3,586,045 | 2/1952 | Hoza | 36/9 R |
| 3,863,272 | 2/1975 | Guille | 36/9 R |
| 4,317,292 | 3/1982 | Melton | 36/9 R |
| 4,443,511 | 4/1984 | Worden et al. | 264/127 |
| 4,499,675 | 2/1985 | Perotto | 36/10 |
| 4,538,368 | 9/1985 | Mugford | 36/7.1 R |
| 4,550,446 | 11/1985 | Herman | 2/239 |
| 4,809,447 | 3/1989 | Pacanowsky et al. | 36/9 R |

FOREIGN PATENT DOCUMENTS

| | | | |
|---|---|---|---|
| 12787 | of 1904 | United Kingdom | 36/9 R |

*Primary Examiner*—Steven M. Meyers

*Attorney, Agent, or Firm*—Kokjer, Kircher, Bradley, Wharton, Bowman & Johnson

[57] ABSTRACT

A sock which comprises an outer shell made up of an arrangement of non-stretchable fabric combined with a panel or panels of stretch fabric and an inner shell of insulating material. The fabrics are lined with a waterproof, breathable liner, such as Gortex or the like. The inner shell is connected with the outer shell only at the open upper end of each. A "stretch" or elastomeric cuff is connected to the open and serves to hold the sock up on the ankle and to prevent loss of heat or entry of water should the leg be immersed above the ankle.

5 Claims, 1 Drawing Sheet

WATERPROOF INSULATED SOCK WITH FOOT CONFORMING CAPABILITY

This is a continuation of copending application(s) Ser. No. 07/144,140 filed Jan. 15, 1988 now abandoned.

FIELD OF THE INVENTION

This invention lies in the field of footwear and deals more particularly with a sock to be worn inside a boot or other outer footwear and which is designed to keep the foot warm and dry under the most severe conditions.

BACKGROUND OF THE INVENTION

Over the years, a wide variety of boot liners and socks have been developed, some intended to be secured to the outer footwear, and some as separate from the footwear. One particular sock of the latter type is disclosed in U.S. Pat. No. 4,550,446. It comprises a sock made from a single piece of a fabric which is coated with a waterproof yet "breathable" layer of GORE-TEX (a trademark of the W. L. Gore & Associates, Inc.). A GORE-TEX coating is applied in the form of a membrane which is a microporous membrane of pure polytetraflourethylene (PTFE) containing more than nine billion pores per square inch. Each pore is twenty thousand times smaller than a drop of water, which makes the fabric to which it is laminated waterproof. Each pore is also, however, seven hundred times larger than a molecule of water vapor thereby allowing water vapor emitted from the foot to pass outwardly through the laminated fabric. This prior art sock may serve to keep the foot dry but it is essentially nonstretchable and difficulty is encountered in fitting it to various foot sizes without developing wrinkles and bunches, which detract from comfort and the uniformity of effect. Such a sock also is made of a relatively thin material and is not designed to be used to provide effective insulation against the cold.

Another sock or liner of which I am aware is a sock made out of a "stretch" material referred to as "STRETCH GORE-TEX". This material has the same characteristics from the standpoint of repelling transmission of water droplets while permitting "breathing" as the nonstretch laminate. The stretch sock is capable of being stretched to "form fit" the foot and ankle but it, like the first example given above, is not designed to provide insulation against the cold. It is also rather expensive to produce, since the entire sock is made of the "stretch" material.

I am also aware, of course, of thermal socks which are intended to insulate only, but do not contain the waterproof protection.

The principal object of my invention is to provide a sock which can be worn inside a wide variety of footwear and which is designed (a) to conform in shape to the contours of the foot, even though it includes a substantial quantity of nonstretch material; (b) which is designed to keep the foot dry, either by permitting escape of vapor from perspiration or from entry of outside water; and (c) which provides insulation against loss of warmth.

It is a further object of the invention to produce a sock which achieves the foregoing objectives and yet which can be manufactured and sold at a relatively reasonable cost, which is light in weight and which is capable of withstanding long and rugged use.

SUMMARY OF THE INVENTION

The objectives of my invention are achieved through provision of a sock which comprises an outer shell made up of an arrangement of nonstretchable fabric combined with a panel or panels of stretch fabric and, if desired, an inner shell of insulating material. In the preferred form, the fabrics are lined with a waterproof, breathable liner, such as GORE-TEX or the like. The inner shell is connected with the outer shell. A "stretch," or elastomeric cuff is connected to the open end and serves to hold the sock up on the ankle and to prevent loss of heat or entry of water should the leg be immersed over the ankle.

DETAILED DESCRIPTION OF THE DRAWINGS

In the accompanying drawing which forms a part of the specification and is to be read in conjunction therewith, and in which like reference numerals indicate like parts in the various views.

Figure 1:
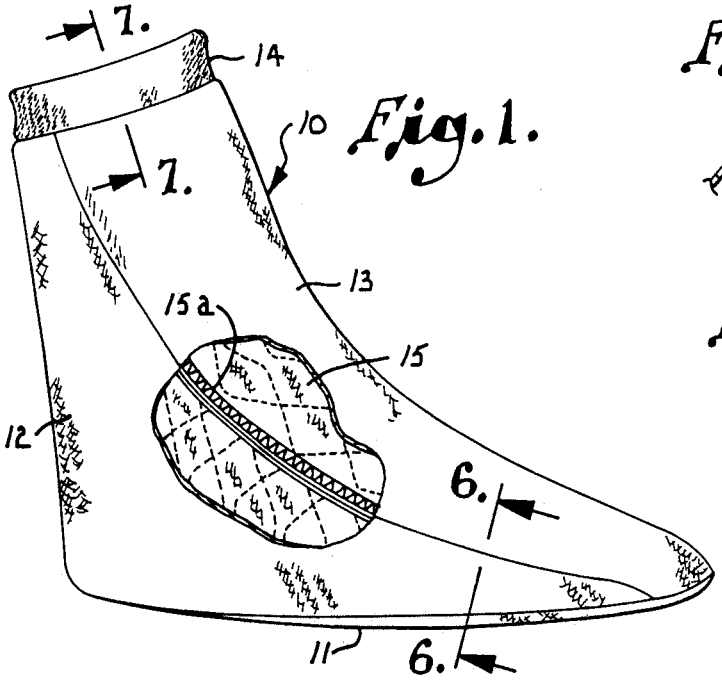
FIG. 1 is a side elevational view of the preferred embodiment of the invention, part of the outer shell being broken away for purposes of illustration.

The outer shell 10 of the sock illustrated in FIG. 1 is constructed from four pieces of material. These are identified as the sole panel 11, an ankle riser panel 12, an inner insulating sock 15 all as will be described hereinafter.

The sole panel 11 is located at and forms the bottom of the outer shell.

Figure 5:
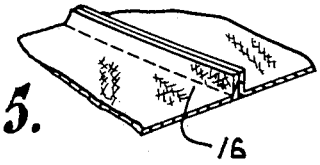
FIG. 5 is a fragmentary perspective view illustrating an intermediate fabrication stage in the manufacture of the product.
Figure 4:
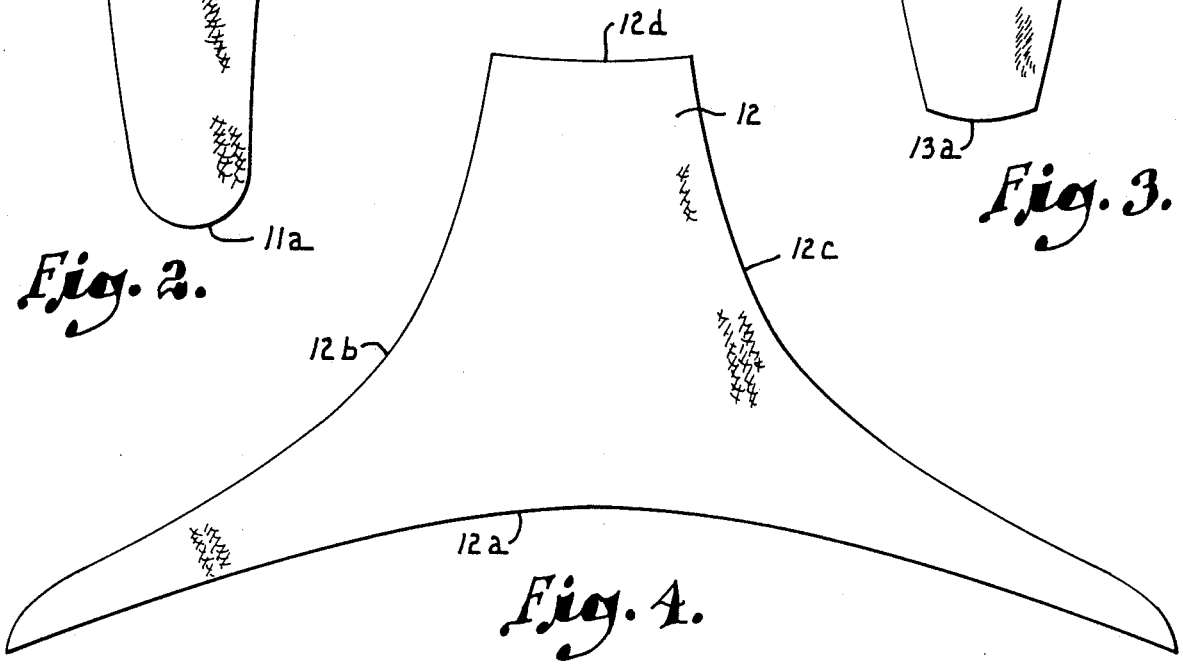
FIG. 4 is a laid out plan view of the riser or ankle panel.

The ankle riser panel 12 has a bottom edge **12*a* (see FIG. 4) which is sewn to the edges of the sole panel at the sides and around the heel 11*a*. FIG. 5 illustrates the manner of connection with stitching shown at 16. The seam is an internal seam. The ankle riser panel does not extend completely around the ankle but instead, has the spaced side edges 12*b*, 12*c* which run from the top edge 12*d*** to the sole. It will be notes that the riser panel does not cover the toe portion of the sole panel.

Figure 3:
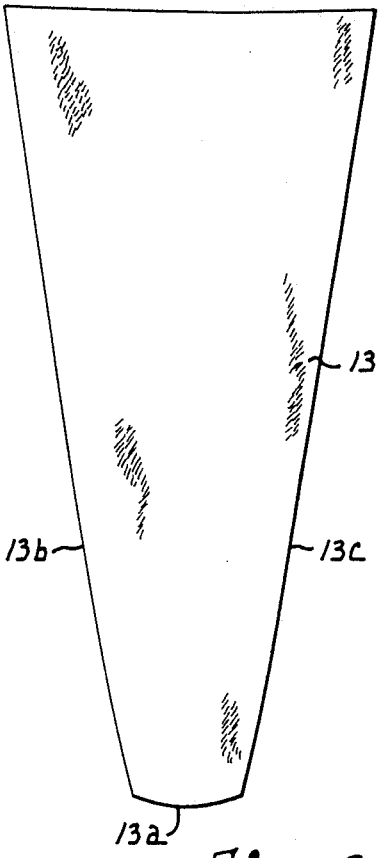
FIG. 3 is a plan view of the instep panel.
Figure 2:
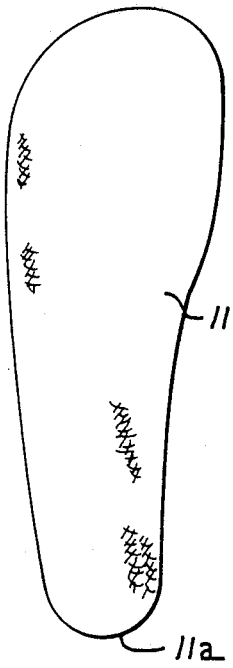
FIG. 2 is a plan view of the sole panel of the outer shell.

The instep and toe cover portion of the sock is provided by the instep panel 13 having a generally trapezoidal outline as illustrated in FIG. 3. The bottom edge **13*a* of the instep panel is sewn to the toe portion of the sole and fills the gap between the edge end of the riser panel. The side edges 13*b*, 13*c* are sewn to the side edges 12*b*, 12*c* of the ankle riser. The manner of construction is the same as earlier described and illustrated in FIG. 5**.

Figure 7:
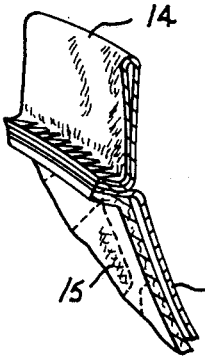
FIG. 7 is a fragmentary sectional view taken generally along line 7—7 of FIG. 1 in the direction of the arrows.

The upper edge **12*d* of the riser panel and upper edge 13*d* of the instep panel define an opening which is surmounted by the cylindrical cuff 14**. The cuff is a doubled piece of fabric whose free edges are sewn to the respective edges of the riser and instep panels as illustrated in FIG. 7.

The material of which the sole and riser panels are constructed is preferably a nylon, or nylon and rayon blend fabric which is lined on the interior with the heretofore described GORE-TEX membrane. This provides a flexible, lightweight, tough material that has the characteristics of external waterproofing and breathability desired.

The instep panel and cuff are each formed of a stretchable, or a elastomeric, fabric which is also waterproof and breathable. A suitable fabric of this type is disclosed in U.S. Pat. No. 4,443,511, issued Apr. 17, 1984, and often referred to as STRETCH GORE-TEX. This is, as described in the patent, a Lycra (E. I. DuPont de Nemours and Company) fabric covered with a GORE-TEX membrane having stretch capability.

Figure 6:
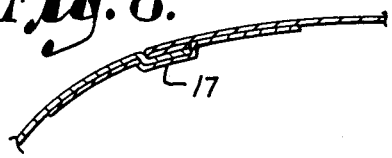
FIG. 6 is a fragmentary sectional view taken generally along line 6—6 of FIG. 1 in the direction of the arrow.

The sewn seams of the outer shell are all made waterproof by application of an adhesively attached tape along the seam as illustrated in FIG. 6. The tape 17 has a width sufficient to cover the flattened standing edges of the seam and extend to either side thereof. The tape may be of the type and applied by the method described in U.S. Pat. No. 4,550,446, to which reference has earlier been made.

The outer shell contains an insulating inner shell or liner 15 which is made of any suitable thermally insulating fabric. A preferred insulation is eighty grams per yard Stretch Thinsulate (3M Company). I prefer a structure which has the same pattern panels as the outer shell, i.e., sole, riser and instep. In the case of the inner shell the seams are on the outside of the shell as shown at 15*a* in FIG. 1. The inner shell 15 is attached to the outer shell at the cuff by the stitching which joins the cuff to the edges of the riser and instep of the outer shell as illustrated in FIG. 7. The inner shell is thus free floating with respect to the outer shell, which enhances the comfort fit which the sock provides.

While the preferred embodiment of the invention includes the combination of inner thermal insulating shell and outer waterproofing shell, it is entirely possible that where thermal insulation is not required, the outer shell alone will suffice. It should be understood that while I have shown one preferred pattern of stretch and nonstretch material for the sock, other patterns are possible while still retaining the benefits of the invention.

From the foregoing, it will be seen that this invention is one well adapted to attain all of the ends and objects hereinabove set forth together with other objects and advantages which are inherent to the structure.

It will be understood that certain features and subcombinations are of utility and may be employed without reference to other features and subcombinations.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. An insulated sock having ability to conform itself to the human foot and comprising generally a sole shaped in plan like the sole of a typical human foot and defined on its perimeter by an edge;

an ankle and instep enclosing section joined with the edge of the sole and having an open upper end;

at least one portion of said section made of a flexible, relatively non-stretchable fabric and another portion made of a flexible elastomerically stretchable material, said another portion defining a flexible elastomerically stretchable segment having one end edge forming part of the joinder between said section and said sole, and extending upwardly to another end edge which forms part of the said upper end whereby to facilitate confirmation of the ankle and instep enclosing section to the foot when the sock is drawn on the foot; and an inner shell within the sock, said inner shell made from a thermally insulating material.

2. A sock as in claim 1;

said sole and section being lined with a material capable of resisting passage of water droplets but permitting passage of water vapor molecules.

3. The sock as in claim 1, said inner shell connected with said sock only at the open end thereof.

4. A sock as in claim 1, said sole comprising a sole panel shaped in plan like the sole of a typical human foot and defined on its perimeter by an edge having an curved heel portion, side portions extending from the heel portion and a curved toe portion connecting the side portions;

said section including:

(1) an ankle riser having a lower edge conforming in shape with the side and heel portions of the sole edge and connected therewith, said riser defining an enclosure of generally U-shaped cross section for enclosing the back and sides of an ankle and instep of the foot when the sock is being worn, said riser having spaced free edges extending upwardly and rearwardly from a forward most point of connection of the side portions with the sole edge at the toe portion and a top edge; and (2) an instep panel connected at one end with and conforming to said toe portion of said sole and having opposite side edges connected respectively with the free edges off said riser continuing to the top of said riser.

5. A sock as in claim 4;

said riser, sole and instep panel being lined with a material capable of resisting passage of water droplets but permitting passage of water vapor molecules.

* * * * *